United States Patent [19]

Kjersem

[11] Patent Number: 4,668,015

[45] Date of Patent: May 26, 1987

[54] CHAIR WITHOUT A BACK/A STOOL

[76] Inventor: Jens A. Kjersem, Einarvikgaten 1, N-6000 Ålesund, Norway

[21] Appl. No.: 921,533

[22] Filed: Oct. 16, 1986

[30] Foreign Application Priority Data

Oct. 24, 1985 [NO] Norway ..... 854262

[51] Int. Cl.[4] ..... A47C 7/02

[52] U.S. Cl. ..... 297/458

[58] Field of Search ..... 297/458, 459, 452, 423

[56] References Cited

U.S. PATENT DOCUMENTS

| | | | |
|---|---|---|---|
| 4,306,750 | 12/1981 | Wenger et al. | 297/458 |
| 4,489,982 | 12/1984 | Morrow | 297/458 |
| 4,500,137 | 2/1985 | Morehouse | 297/458 |
| 4,534,590 | 8/1985 | Yamamura et al. | 297/423 X |

*Primary Examiner*—Philip C. Kannan

*Attorney, Agent, or Firm*—Browdy and Neimark

[57] ABSTRACT

A chair without a back/a stool, having an upholstered seat where an elastic, yielding upholstery material, for example foam rubber, is arranged on a carrying frame attached to the base of a chair. The carrying frame comprises a front, transverse support section and a back, transverse support section connected with each other by means of longitudinal frame sections, possibly directly to the base. The front, support section is arranged lower than the back, support section, and a possibly additional, transverse support section is arranged between said front, support section and said back, support section, close to and lower than the support section, possibly around the same height, for the correction of a person's sitting position.

10 Claims, 8 Drawing Figures

Fig. 6.
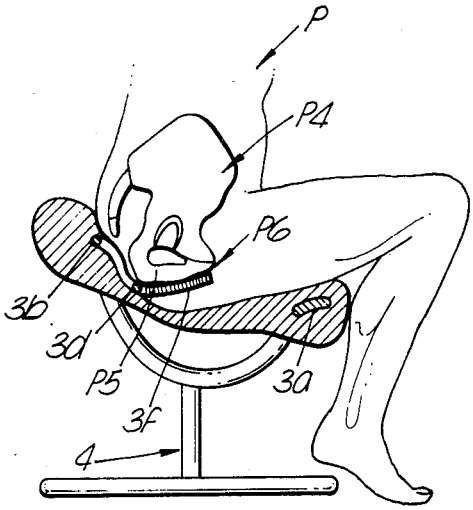
Fig. 7.
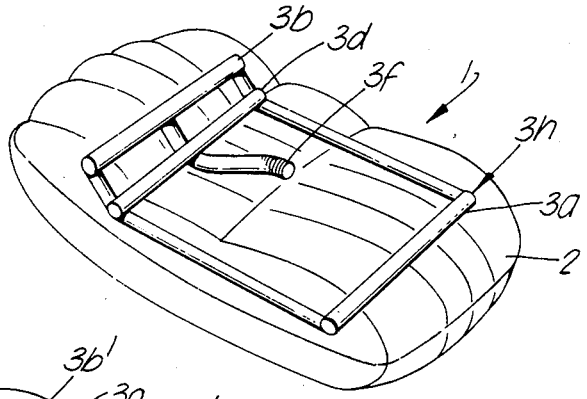
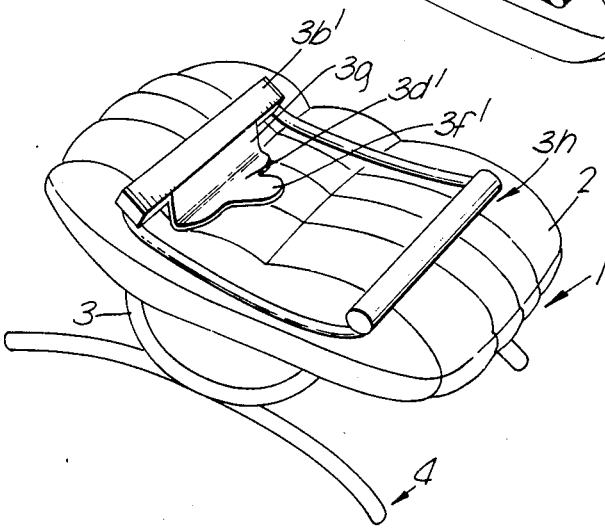
Fig. 8.

CHAIR WITHOUT A BACK/A STOOL

The present invention relates to a chair without a back, possibly a stool, of the type disclosed in the introduction to the following independent claim 1.

Prior art shows seats of chairs formed out of a rigid, partly slippery material where possibly raised side sections and a raised back section conduct/direct a person's posterior parts to a preferred sitting area on the seat and possibly prevent him from sliding out of the seat in a forward/backward direction or in a lateral direction when the seat is mounted on a movable base, such as a vehicle, for example a tractor.

However, the known, shaped seats of chairs without backs do not have such a design that they correct a person's sitting position, for example from a sitting position with a bent back to a sitting position with a straightened-out spinal column having a normal sway in the lumbar region.

The purpose of the present invention is to provide a seat of a chair without a back or of a stool of the type mentioned by way of introduction, on which a person can sit comfortably at the same time as his sitting position is corrected to obtain a straightening-out of his entire spinal column to an upright position with a normal sway in the lumbar region.

In order to achieve such a sitting position by "force," that is, the shape of the seat forces a person into a "correct" sitting position, the pelvic bones of the sitting person must be tilted forward in the upper region, the tilting point being in the lower region of the pelvic bones—the ischial tuberosity—in the person's posterior parts. To maintain the pelvic bones at said forward tilt and thus with the desired sway in the small of the back (the lumbar column), the person must be supported at the very back of his posterior parts, in the area straight under his tailbone—coccyx. The correction of a person's sitting position and the maintenance of a the corrected position is, according to the present invention, achieved by means of a seat having the characteristic features disclosed in the characterizing clause of the following independent claim 1 and in the other independent claims. An embodiment of the subject of the invention will be further described in the following paragraphs, with reference to the drawing, where FIG. 1 shows a chair according to the invention, with a person in the initial/preliminary sitting position, and FIG. 2 shows the same chair with a person in the corrected sitting position;

Figure 1:
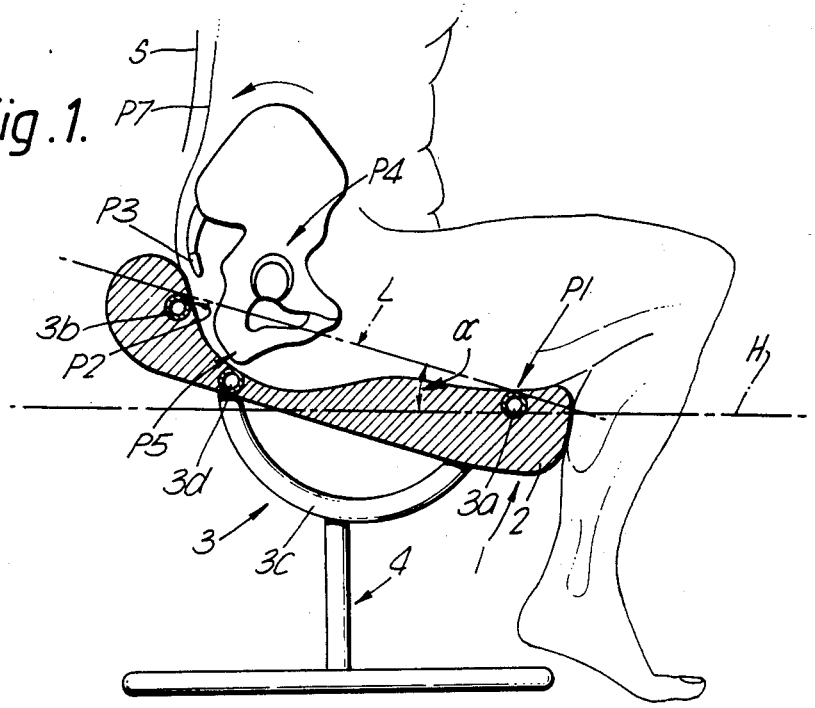

FIG. 6 a chair with a person in the corrected sitting position and the intermediate support section equipped with a projecting support section to bear against the person's crutch;

FIG. 7 and 8 show the seat of the chair according to the invention in perspective, with the support sections drawn into the upholstery material of the pillow. The chair without a back or the stool is composed of an upholstered seat 1 where an elastic, yielding upholstery material 2, for example foam rubber, is arranged on a carrying frame 3 attached to the base 4 of the chair. The carrying frame 3 comprises a front support section and a back transverse support section 3*a*, 3*b*, interconnected by means of longitudinal frame sections 3*c*, which can run along the upholstery 2 through or outside of the upholstery material or in a downwardly directed arch on each side of the upholstery material. Said longitudinal frame sections 3*c* can be attached in their center to the base 4 of the chair, as shown in FIG. 1, or in some other way; for example, the base 4 of the chair may be connected with the end portions of the transverse support sections 3*a*, 3*b*. The front support section 3*a* is arranged lower than the back support section 3*b*, and an additiaonal transverse support section 3*d* is arranged between said front support section and the back support section 3*a* and 3*b*. The support section 3*d* is arranged close to and lower than the back support section 3*b* and higher, lower or level with the front support section 3*a*. A line L through the front and the back support section 3*a*, 3*b* forms an acute angle with the horizontal plane H. The angle has a range of 5° to 35° and is preferably circa 15°–20°.

The front and the back support sections 3*a*, 3*b* are intended to bear against the middle of the back side of the thigh Pl of a sitting person P, respectively his posterior parts P2, that is, lower than the person's tailbone P3—coccyx or possibly sacral apex.

Figure 2:
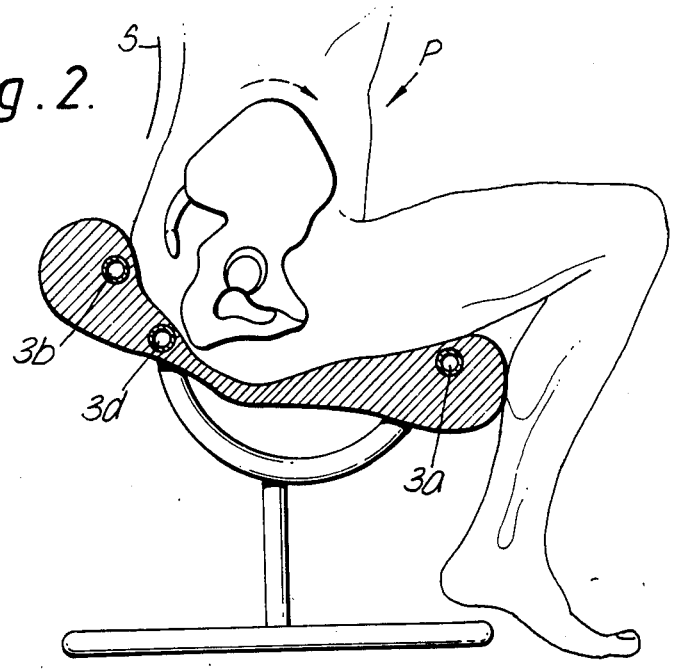

The intermediate support section 3*d* is designed so that, when a person sits down, it first comes to bear against the lower part P5 of his pelvic bones P4—ischial tuberosity. The usual back tilt of the pelvic bones P4 that the user has when he sits down will receive a forward push since the ischial tuberosity P5 meets a more rigid contact, thus creating a friction that stops the forward/downward sliding along the intermediate support section 3*d*, so that this section comes to bear against and support the side underneath or at the back of the ischial tuberosity P5. Thus the upper section of the pelvic bones P4 is tilted forward to achieve a normal sway S in a person's lumbar region 7 and consequently a straightening-out of the whole spinal column. Through this process a better sitting position is achieved, as shown in FIG. 2, where one clearly sees that the back side of the ischial tuberosity P5 is supported by the intermediate support section 3*d*, whereas the front support section 3*b* bears against the person's posterior parts P2 below the tailbone P3.

Said front, back and intermediate support section 3*a*, 3*b* and 3*d* can also be described as follows:

The front support section 3*a*="the hamstring contact."

The back support section 3*b*="the coccyx/sacral apex contact."

The intermediate support section 3*d*="the ischium contact."

These are the essential points of contact between a person's body and the chair according to the invention.

Figure 3:
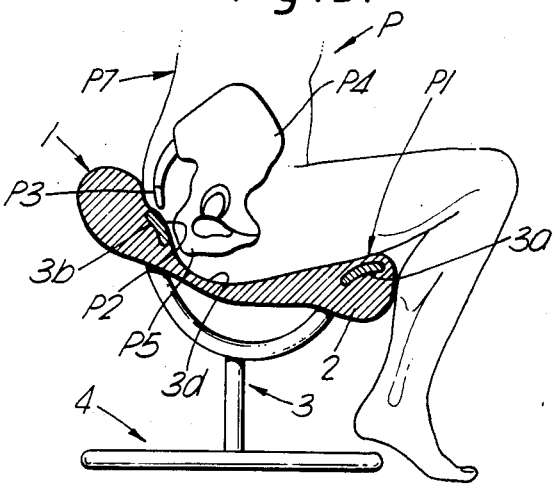
FIG. 3 shows a chair with a person in the corrected sitting position, where the intermediate support section 3*d* is omitted, the bottom of the seat's 1 sitting cavity being so firm that it prevents a further sliding.
Figure 4:
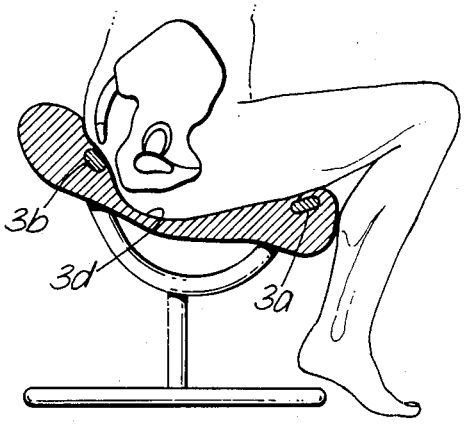
FIG. 4 shows the same details as FIG. 3, but with a smaller width in the back support section.
Figure 5:
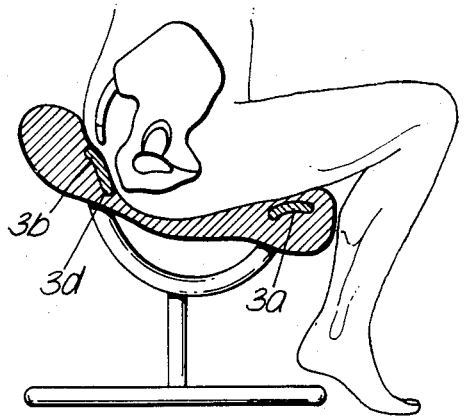
FIG. 5 shows a chair with a back support section and an intermediate support section in one unit and with a person in the corrected sitting position.

As shown in FIGS. 3 and 4, the intermediate support section 3*d* can be omitted provided that the bottom of the sitting cavity in the seat 1 is so firm that it prevents a further sliding, as is also shown in FIG. 4. The intermediate and the back support sections 3*d*, 3*b* can also be combined into one section, such as shown in FIG. 5 where the back support section 3*b* is made broader to support the back side of the ischial tuberosity P5 and the posterior parts P2 below the tailbone P3—coccyx.

FIG. 6 shows a chair with the intermediate and the back support sections 3*d*, 3*b* combined, the intermediate support section having a projection 3*f* that bears against the person's P crutch P6 to support the pubic symphysis. This design prevents the pelvic bones from hanging too far forward and thus increasing the lumbar lordosis (straightened-out swayback).

Two embodiments of the chair according to the invention are shown in FIGS. 7 and 8, where the support section 3*f* bearing against the person's P crutch—the pubic symphysis—P6 is formed as a longitudinal body connected with the intermediate and back support sections 3*d*, 3*b* and shaped to bear against the bottom of the pelvic bones P4 from the ischial tuberosity P5 to the pubic symphysis P6.

FIG. 8 shows that the back, intermediate and central support sections 3*b*, 3*d*, 3*f* make up a plate formed by a transverse surface in the back 3*b*', a downward step 3*g* and a lower, transverse surface 3*d*' which extends in an upward direction into a narrow projection 3*f*'.

Furthermore, both FIGS. 7 and 8 show that at least two of the support sections 3*a*, 3*b*, 3*d*, 3*f* make up a frame 3*h* embedded in the upholstery material 2 of the seat 1. The frame 3*h* is further connected with the base 4 of a chair either directly or through a carrying frame 3.

FIGS. 6 and 7 have thus a frame 3*h* that, by means of good upholstery, make cushioned "cribs" for the ischium P5 and pubis P6 and practically locks the pelvis P4 into the desired position, achieving a kind of "saddle" effect in a normal sitting position.

Having described my invention, I claim:

1. A chair without a back/a stool having an upholstered seat where an elastic, yielding upholstery material, for example foam rubber, is arranged on a carrying frame attached to the basis of a chair, said carrying frame comprising a front, transverse support section and a back, transverse support section, characterized in that the front support section is arranged lower than the back support section, and that an additional support section is arranged between said front support section and said back support section, close to and lower than the back support section and higher than the front support section, for the correction of a person's sitting position.

2. A chair according to claim 1, characterized in that the front and the back support sections are intended to bear against the middle of the back side of a person's thighs, respectively posterior parts lower than the person's tailbone—coccyx, and that the intermediate support section is intended to effect, at the initial bearing against the lower section of the pelvic bones—the ischial tuberosity, a backward tilt of the upper section of the pelvic bones and thus a forward/downward slide of this part along the intermediate support section so that the latter bears supportingly against the back side of the ischial tuberosity and tilts the upper section of the pelvic bones forward to achieve a normal sway in the person's lumbar region, and thus a straightening-out of the entire spinal column, resulting in a better sitting position.

3. A chair according to claim 1, characterized in that a line through the front and the back support sections forms an acute angle with a horizontal plane.

4. A chair according to claim 3, characterized in that the angle has a range of 5°–35°.

5. A chair according to claim 1, characterized in that the intermediate support section is formed by the sitting cavity of the seat and rigidity shaped to prevent a further downward and forward slide of the posterior parts when the person sits down.

6. A chair according to claim 1, characterized in that the intermediate and back support sections are made into one unit.

7. A chair according to claim 1, characterized in that at least one of the back or intermediate support sections is connected with a support section projecting past the intermediate support section and located centrally in terms of the width of the seat to give a supportive bearing against a person's crutch—the pubic symphysis.

8. A chair according to claim 7, characterized in that the central support section is a longitudinal body shaped to bear against the pelvic bones from the ischial tuberosity to the pubic symphysis.

9. A chair according to claim 7, characterized in that the back, intermediate and central support sections form a plate shaped with a back, transverse surface, a step down and a lower, transverse surface extending into an upwardly directed, narrow projection.

10. A chair according to claim 1, characterized in that at least two of the support sections form a frame embedded in the upholstery material of the seat.

* * * * *